United States Patent [19]

Schreck et al.

[11] 4,333,588

[45] Jun. 8, 1982

[54] ICE DISPENSER ASSEMBLY

[75] Inventors: Raymond M. Schreck; Bill G. Brown; David A. Gilda, all of Louisville, Ky.

[73] Assignee: General Electric Company, Louisville, Ky.

[21] Appl. No.: 176,301

[22] Filed: Aug. 8, 1980

[51] Int. Cl.[3] ..... F25C 5/18

[52] U.S. Cl. ..... 222/164; 222/173; 312/236; 62/344

[58] Field of Search ..... 222/160, 164, 165, 166, 222/173, 180; 312/236, 302, 303; 62/344

[56] References Cited

U.S. PATENT DOCUMENTS

| | | | |
|---|---|---|---|
| 2,704,237 | 3/1955 | Nave . | |
| 2,898,173 | 8/1959 | Squire . | |
| 2,901,308 | 8/1959 | Attwood | 312/303 |
| 3,295,908 | 1/1967 | Dawley et al. | 312/303 |
| 3,519,319 | 7/1970 | Taylor . | |
| 3,640,088 | 2/1972 | Jacobus et al. . | |
| 3,744,270 | 7/1973 | Wilcox . | |
| 3,878,693 | 4/1975 | Prada . | |
| 4,087,140 | 5/1978 | Linstromberg . | |
| 4,095,439 | 6/1978 | Linstromberg . | |
| 4,269,039 | 5/1981 | Baker | 62/344 |

*Primary Examiner*—Joseph J. Rolla

*Attorney, Agent, or Firm*—Frederick P. Weidner; Radford M. Reams

[57] ABSTRACT

An ice dispenser assembly including an ice piece storage receptacle having an open top and including means for dispensing ice pieces contained therein. A stationary track member is provided on each side of the ice piece storage receptacle and each track member has a rearward horizontal portion, a forward downwardly curved portion, and a forward upwardly curved portion. Two pairs of spaced guide elements, each pair including a forward guide element and a rearward guide element are secured to the receptacle on each side thereof and slidable in each of the stationary track members to move the ice piece storage receptacle from a first position to a second position. The pairs of guide elements are located in their rearward horizontal portion of the track members when the ice piece storage receptacle is in its first position and the forward guide element of each pair of guide elements is in the downwardly curved portion and the rearward guide element of each pair is in the upwardly curved portion when the receptacle is in its second position. By this arrangement the ice piece storage receptacle may be tilted downwardly thus allowing bulk ice piece access through the top opening of the receptacle.

8 Claims, 7 Drawing Figures

ICE DISPENSER ASSEMBLY

BACKGROUND OF THE INVENTION

This invention relates to an automatic ice making and dispensing service for a conventional household refrigerator.

Many household refrigerators feature automatic ice making apparatus including a collecting and storage bin or receptacle in which the ice pieces are stored at below-freezing temperatures for removal by the user. Various ice makers previously used or proposed have also included means for dispensing ice pieces individually or in batches of two or three pieces. It is desirable to have such automatic ice making and dispensing apparatus take up as little usable storage space in the refrigerator freezer compartment as possible. For this purpose, it is common to either place the ice piece receptacle including the dispensing means as close as possible to the top wall of the freezer compartment or to a shelf above which frozen articles may be stored. This is particularly true in top mount refrigerators, that is, those refrigerators having a freezer compartment on top and a fresh food compartment below with the freezer extending across the top of the refrigerator.

In automatic ice piece dispensing apparatus, it is desirable to have the ice pieces dispensed through the freezer door to an ice service center on the outside surface of the freezer door not only for convenience of the user but also as a means of saving energy by not needing to open the large freezer door when the user desires ice pieces. It is found in many cases that because of the overall freezer compartment height limitations, the user does not have access to bulk ice removal from the ice piece receptacle without removing the complete receptacle including the stored ice and the dispensing apparatus from the freezer compartment. In such cases, the ice piece receptacle is quite heavy and very cumbersome to handle in removing and reinstalling it should the user desire bulk ice service.

The present invention allows for easy access for bulk ice service yet minimizing the space within the freezer compartment taken up by the ice piece receptacle and dispenser apparatus.

SUMMARY OF THE INVENTION

According to one aspect of our invention, there is provided an ice dispenser assembly for use in a freezer compartment of a refrigerator including a motor-driven ice dispenser. The assembly includes an ice piece storage receptacle having an open top and including means for dispensing ice pieces contained therein. A stationary track member is provided on each side of the ice piece storage receptacle and each track member has a rearward horizontal portion, a forward downwardly curved portion, and a forward upwardly curved portion. There is also provided two pairs of spaced guide elements, each pair including a forward guide element and rearward guide element. One pair of said guide elements is secured to the receptacle of each side thereof and slidable in each of the respective stationary track members to move the ice piece storage receptacle from a first position to a second position. The pairs of guide elements are located in the rearward horizontal portion of the track members when the ice piece storage receptacle is in its first position and the forward guide element of each pair of guide elements is in the downwardly curved portion and the rearward guide element of each pair is in the upwardly curved portion when the receptacle is in its second position. By this arrangement, the user may move the ice piece storage receptacle from its first position outwardly of the freezer compartment whereupon the front of the ice piece storage receptacle will tilt downwardly thus allowing bulk ice piece access through the top opening of the receptacle yet the receptacle is supported by the stationary track members thus minimizing manual effort on the part of the user.

DESCRIPTION OF THE PREFERRED EMBODIMENT

Figure 1:
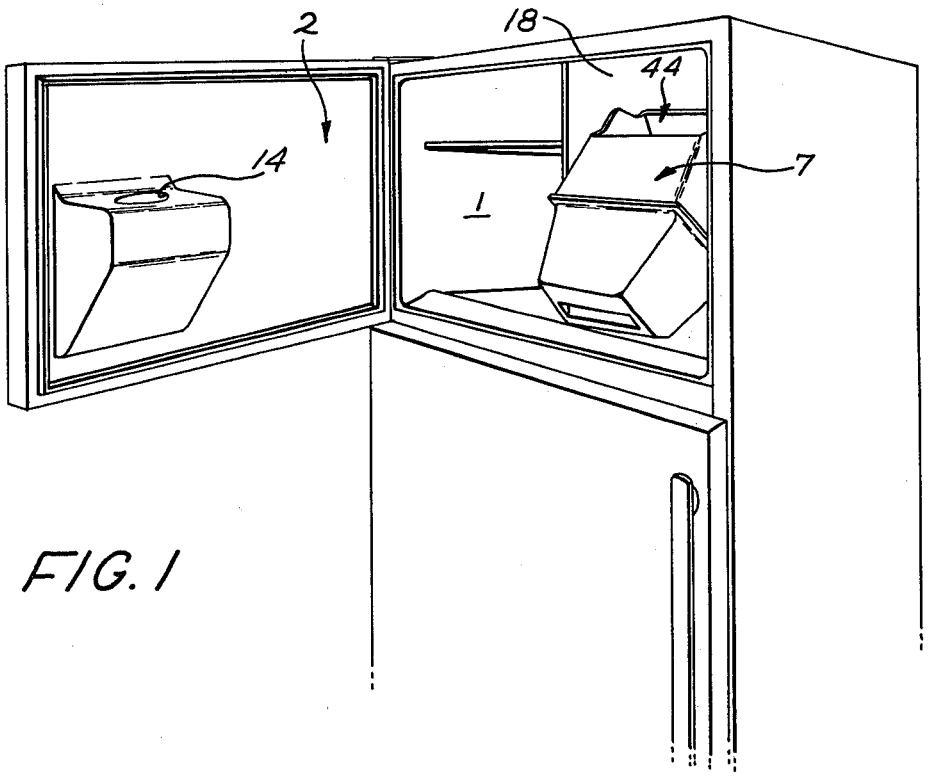
FIG. 1 is a perspective view of a household refrigerator having the freezer compartment on top and shows the ice dispenser assembly in position for the user to have access to bulk ice pieces therein.
Figure 5:
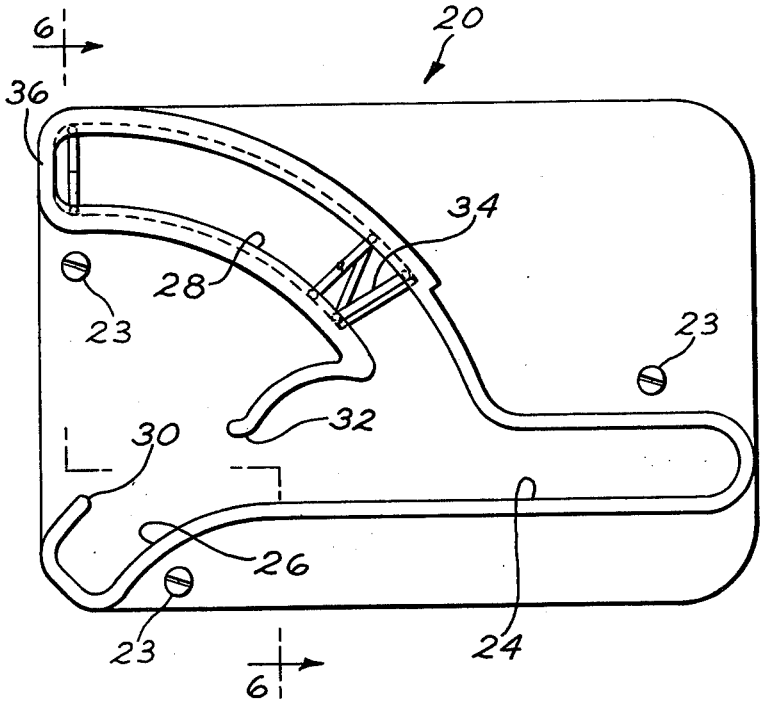
FIG. 5 is a side elevational view of a track member of the ice dispenser assembly.
Figure 6:
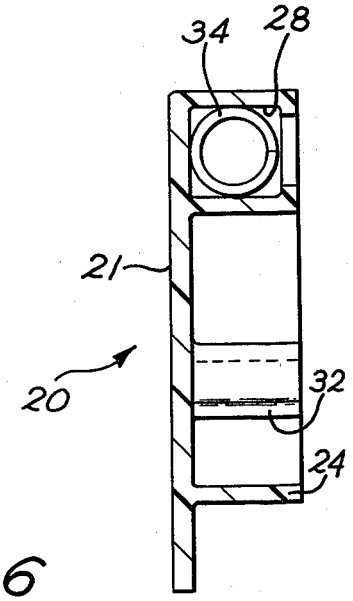
FIG. 6 is a view taken along lines 6—6 of FIG. 5.

While the ice dispenser assembly of the present invention may be provided in any refrigerator, including a freezer compartment and a door for closing the access opening to that compartment, it will be particularly described in its application to a cabinet containing, a top mount refrigerator wherein the freezer compartment is across the top of the cabinet and the fresh food compartment is below the freezer compartment. More specifically, in the accompanying drawing, there is illustrated a refrigerator, including a freezer compartment 1 extending substantially the full width of the cabinet and having an access opening at the front thereof closed by a door 2. The door includes an outer panel 3 forming the outer surface or face of the door and provided with a recess 4 generally defining a service center or area to which ice is delivered exteriorly of the cabinet from an ice dispenser 6 disposed in the upper portion of the freezer compartment 1, that is, above the level of the recess 4.

Figure 2:
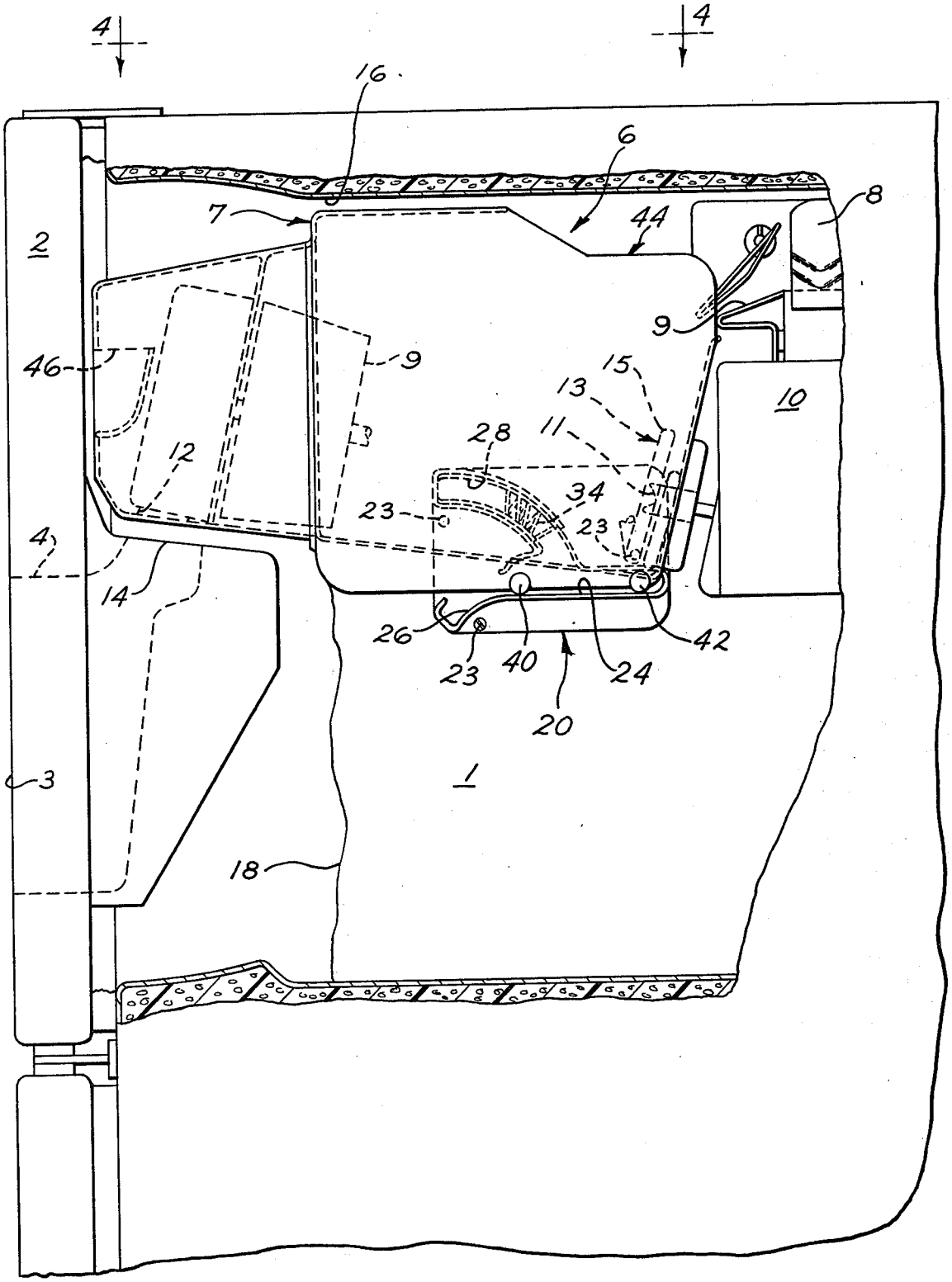
FIG. 2 is a side elevational view of a freezer compartment of a household refrigerator with parts broken away and including the ice dispenser assembly shown in its ice storage position.

With reference particularly to FIG. 2, the ice dispenser 6, briefly described, includes an ice piece storage receptacle 7 for receiving and storing ice pieces produced by an ice maker 8. The ice maker 8 is conventionally an apparatus that freezes water in a mold and periodically harvests the ice pieces therefrom and delivers them into the ice piece storage receptacle 7 by means of an inclined ramp 9. The ice piece storage receptacle 7 contains dispensing means generally indicated by the numeral 13 driven by a motor 10 usually through a speed reduction drive (not shown). The dispensing means extends lengthwise of the receptacle 7 and includes a feed section 9 at the front end thereof and a conveyor section 15 in the form of a spiral interconnecting the feed section 9 and the drive means 11. Upon rotation of the dispensing means, ice pieces stored in the receptacle are advanced by the conveyor section 15 to the feed section 9 for discharge through an opening 12 at the front portion of the feed section 9. A similar ice piece dispensing arrangement is disclosed in U.S. Pat. No. 3,640,088.

A passage 14 extending from below the opening 12 of the ice dispenser to the ice service area access 4 is provided for conveying ice pieces discharged by the dispenser 6 to the service area.

As can be particularly seen in FIG. 2, the ice piece storage receptacle 7 is positioned very close to the top wall 16 of the freezer compartment 1 to minimize the amount of usable storage space taken up within the freezer compartment by the receptacle. In the case of a top mount type refrigerator, the freezer compartment 1 may have a vertical partition 18 (FIG. 1) to separate the ice dispenser assembly from food packages stored in the freezer compartment 1. In side-by-side refrigerators that have vertical freezer and fresh food compartments there may not need to be such a partition as the freezer compartment is relatively narrow. The ice dispenser assembly of our invention includes a stationary track member 20 on each side of the ice storage receptacle 7. The stationary track members 20 are secured by a suitable means such as screws 23 to supports within the freezer compartment 1 which, in this case, includes the side wall 22 of the freezer compartment 1 on one side of the receptacle and the partition 18 on the opposite side of the receptacle. Each track member includes a rearward horizontal portion 24, a forward downwardly curved portion 26, and a forward upwardly curved portion 28. The track member 20 has a base 21 from which walls forming the rearward horizontal portion 24, forward downwardly curved portion 26, and forward upwardly curved portion 28, depend perpendicularly. The track member 20 is made from any suitable material and in the preferred embodiment it is molded from plastic material. The forward downwardly curved portion 26 has an opening adjacent 30 in the top wall 32, the purpose of which will be explained later. In the preferred embodiment of the invention, the forward upwardly curved portion 28 has captured within it a compression spring 34 extending between the forward end 36 of the upwardly curved portion and its throat opening 38, the purpose of which will also be discussed later.

Figure 3:
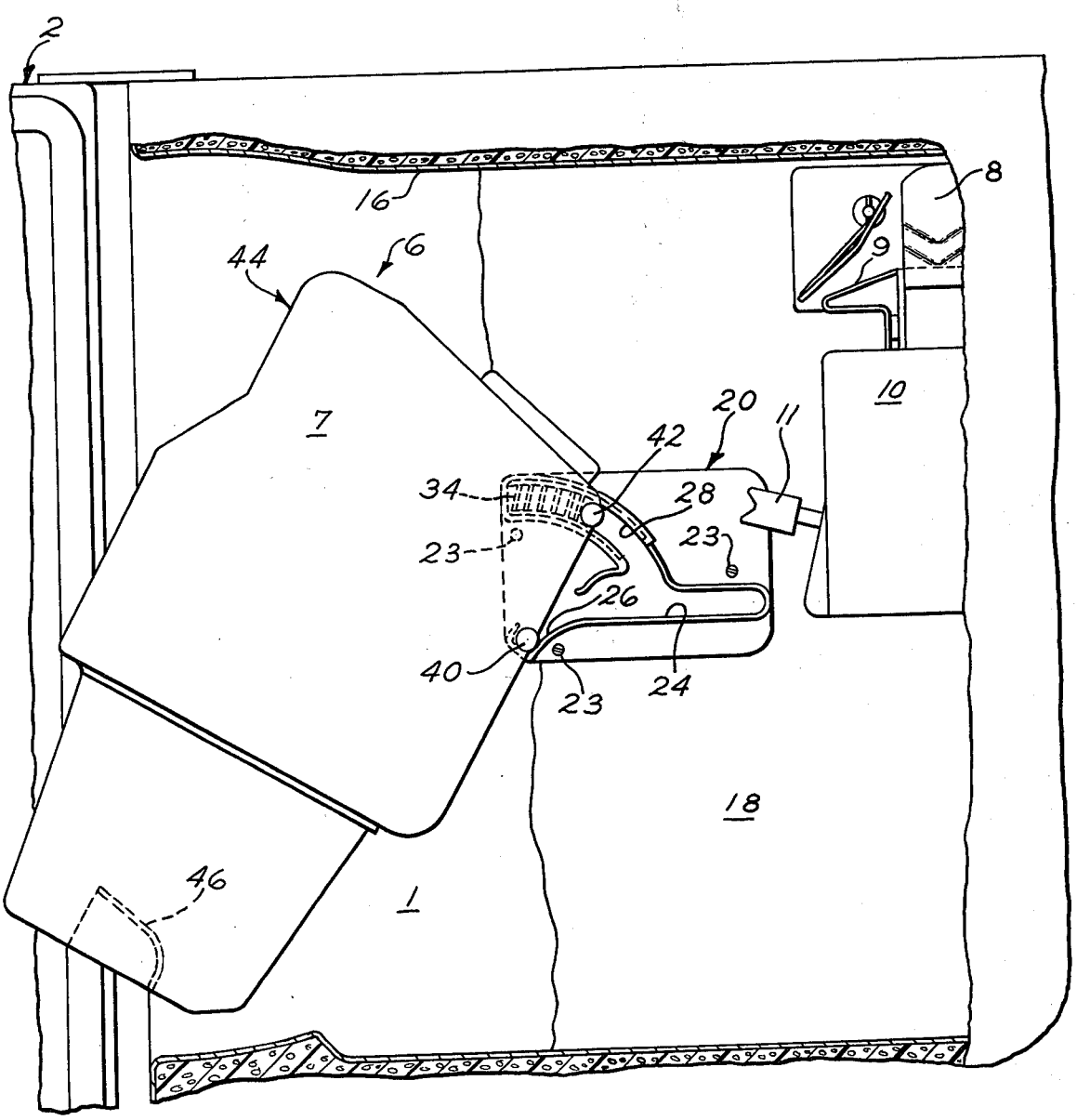
FIG. 3 is a side elevational view of a freezer compartment of a household refrigerator with parts broken away similar to FIG. 2 but showing the ice dispenser assembly in its bulk ice service access position.
Figure 4:
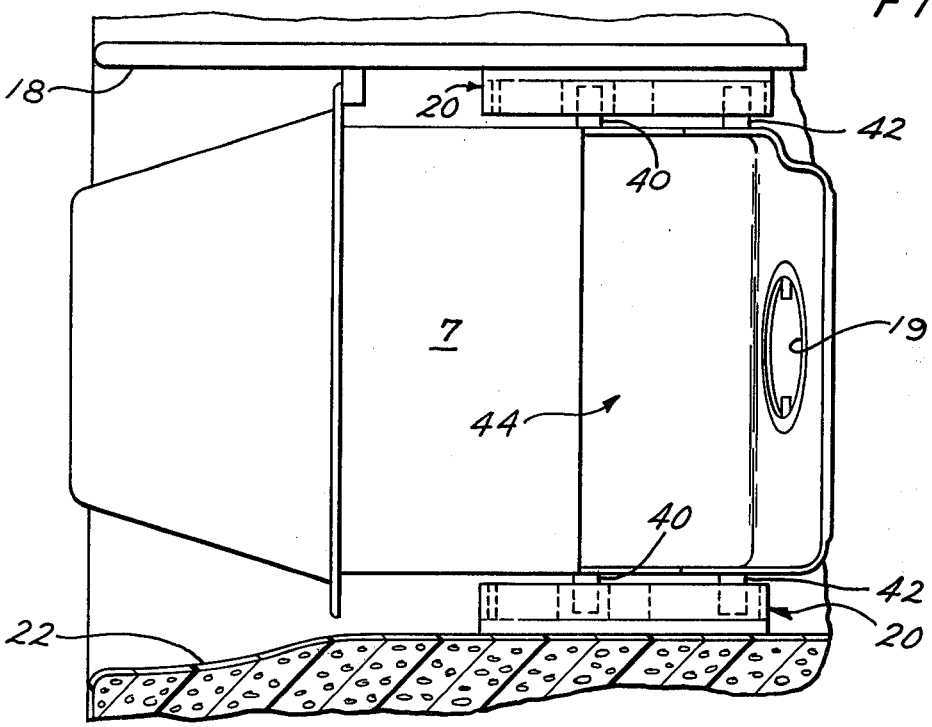
FIG. 4 is a view taken along lines 4—4 of FIG. 2 with parts broken away.

There is provided in the ice dispenser assembly two pairs of spaced guide elements which are secured to the ice piece storage receptacle 7. Each pair of guide elements includes a forward guide element 40 and rearward guide element 42 and both are dimensioned to cooperate with the track members 20 so that they are slidable therein. The pairs of guide elements, each including forward guide element 40 and rearward guide element 42, are located in the rearward horizontal portion 24 of the track members 20 when the receptacle 7 is in a first position as shown in FIG. 2. It will be noted that in this first position of the receptacle 7, the guide elements 40 and 42 are horizontal as viewed in side elevation. With reference to FIG. 3, the ice piece storage receptacle 7 is shown in a second position wherein the forward guide element 40 of each pair of guide elements is in the downwardly curved portion of the track member 20 and the rearward guide element 42 of each pair is in the upwardly curved portion 28. In the second position of the ice storage receptacle, it will be noted that it is tilted or inclined downwardly and, in that position, rearward guide element 42 engages the compression spring 34 captured within the forward upwardly curved portion 28 and movement of the receptacle 7 downwardly compresses the spring 34 which, in effect, progressively dampens the descending rate of the receptacle 7. That is, the movement of the receptacle 7 from the first position to the second position is slowed. It will be noted as seen in FIGS. 1 and 3 particularly, that when the ice piece storage receptacle 7 is in its second position the opening 44 at the top of the receptacle 7 is now accessible to the user so that ice pieces may be manually removed from within the receptacle 7 for bulk ice usage. The opening 44 extends part way from the rear wall 17 of the receptacle 7 toward the front of the receptacle. The entire top of the receptacle 7 is not open as otherwise ice pieces could fall out during movement of the receptacle from its first position to its second position.

When it is desired to restore the ice piece storage receptacle 7 to its first or storage position as shown in FIG. 2, the front of the receptacle is raised upwardly until rearward guide elements 42 pass through the throat opening 38 of the track member 20 and then the receptacle 7 is pushed rearward whereupon the receptacle assumes its first position with the guide elements 40 and 42 again located in the rearward horizontal portion 24.

It will be understood that to accomplish the movement of the ice piece storage receptacle 7 from its first position to its second position and back again, there needs to be a disconnect between the drive means 11 and the ice dispenser 6 located within the receptacle 7. The conveyor section 15 of the dispensing means is rotatably secured to the rear wall 17 of the receptacle 7 which has an opening 19 through which the drive means 11 may project. When the receptacle 7 is in the first or ice storage position the drive means 11 projects through opening 19 and engages the conveyor section 15 in driving relationship. When the receptacle 7 is moved forward in the tracks 20 the drive means 11 which is stationary is withdrawn from the receptacle and is disengaged from the conveyor section 15.

Figure 7:
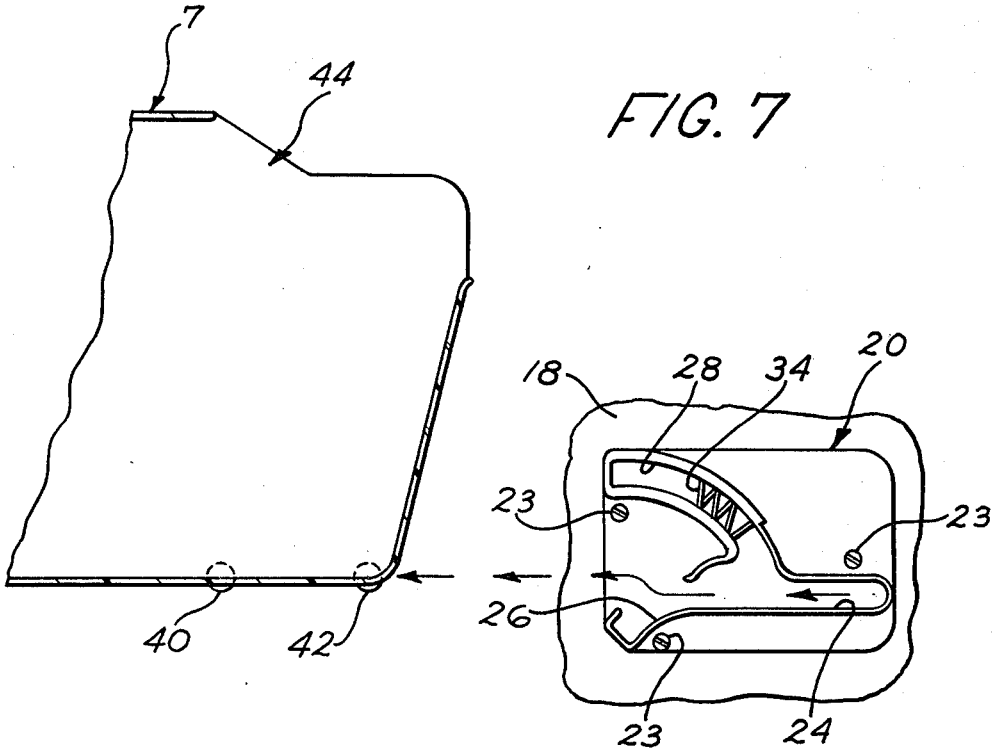
FIG. 7 is a view showing removal of the ice piece storage receptacle from a track member.

There are occasions when it is desirable to remove the ice piece storage receptacle 7 from the freezer compartment 1 such as for cleaning or bulk ice use at a different location and for that purpose it is desirable to have an arrangement that will accommodate such usage. With particular reference to FIGS. 2 and 7, the removal of the receptacle 7 from within the freezer compartment 1 is accomplished by opening the freezer door 2 and moving the receptacle 7 forwardly horizontally so that forward guide element 40 will pass through opening adjacent 30 in the top wall 32 of the tracks 20 instead of following the downwardly curved portion 26 of the track members 20. With continued forward movement of the receptacle 7 the rearward guide element 42 is also passed through the opening 30 and the receptacle 7 is removed from its association with the track members 20 as shown in FIG. 7. To reinstall the ice piece storage receptacle 7, the reverse operation is performed. For convenience in handling the ice piece storage receptacle 7 in moving it to its first or second position or removing it from within the freezer compartment, there is provided a handle 46 for the user to grip and manipulate accordingly the receptacle 7.

The foregoing is a description of the preferred embodiment of the invention and it should be understood that variations may be made thereto without departing from the true spirit of the invention as defined in the appended claims.

We claim:

1. An ice dispenser assembly for use in a freezer compartment of a refrigerator including a motor-driven ice dispenser comprising;

an ice piece storage receptacle having an open top and including means for dispensing ice pieces contained therein, a stationary track member on each side of the receptacle, each track member having a rearward horizontal portion, a forward downwardly curved portion, and a forward upwardly curved portion, two pairs of spaced guide elements, each pair including a forward guide element and a rearward guide element, one pair of said guide elements being secured to the receptacle on each side thereof and slidable in each of the respective stationary track members to move the receptacle from a first position to a second position, said pairs of guide elements being located in the rearward horizontal portion of the track members when the receptacle is in its first position and the forward guide element of each pair of guide elements is in the downwardly curved portion and the rearward guide element of each pair is in the upwardly curved portion when the receptacle is in its second position.

2. The ice dispenser assembly of claim 1 wherein the downwardly curved portion of the track member has an opening in the top wall of the track sufficient to allow the guide elements to pass therethrough so that the receptacle may be removed from the track members.

3. The ice dispenser assembly of claim 1 wherein the ice piece storage receptacle is filled with ice pieces by an automatic ice maker housed within the freezer compartment.

4. The ice dispenser assembly of claim 1 wherein the open top of the ice piece storage receptacle extends part way from the rear of the receptacle toward the front of the receptacle.

5. The ice dispenser assembly of claim 1 wherein the front of the ice piece storage receptacle has a handle for the user to easily move the receptacle between its first and second positions.

6. The ice dispenser assembly of claim 1 wherein the assembly is for use in the freezer compartment of a refrigerator wherein the freezer compartment is across the top of the refrigerator.

7. The ice dispenser assembly of claim 1 wherein the upwardly curved portion of at least one of the track members has dampening means therein to slow movement of the receptacle from the first position to the second position.

8. The ice dispenser assembly of claim 7 wherein the dampening means is a compression spring captured within the upwardly curved portion of at least one of the track members and is compressed by movement of the rearward guide element in the upwardly curved portion of the track member when the receptacle is in its second position.

* * * * *